US005806333A

United States Patent [19]

Kim et al.

[11] Patent Number: 5,806,333

[45] Date of Patent: Sep. 15, 1998

[54] FREEZER COMPARTMENT STRUCTURE FOR REFRIGERATORS

[75] Inventors: Ik Geun Kim; Sang Chul Ryu, both of Suwon, Rep. of Korea

[73] Assignee: Samsung Electronics Co., Ltd., Suwon, Rep. of Korea

[21] Appl. No.: 722,793

[22] Filed: Sep. 27, 1996

[30] Foreign Application Priority Data

Nov. 30, 1995 [KR] Rep. of Korea ..... 1995 45716

[51] Int. Cl.[6] ..... F25C 1/10

[52] U.S. Cl. ..... 62/353; 211/126.15; 211/135

[58] Field of Search ..... 62/340, 344, 353; 211/126.15, 134, 135; 312/408

[56] References Cited

U.S. PATENT DOCUMENTS

| | | | |
|---|---|---|---|
| 2,113,014 | 4/1938 | Copeman | 62/344 |
| 2,115,944 | 5/1938 | De Witt | 62/344 |
| 2,429,882 | 10/1947 | Jennings et al. | 62/344 |
| 2,867,995 | 1/1959 | Weinrich et al. | 62/344 |
| 2,941,377 | 6/1960 | Nelson | 62/344 |
| 3,339,994 | 9/1967 | Reddig et al. | 211/126.15 |
| 4,303,423 | 12/1981 | Webb et al. | 62/353 |
| 5,012,655 | 5/1991 | Chatterton | 62/340 |
| 5,273,354 | 12/1993 | Herrmann et al. | 312/408 |

FOREIGN PATENT DOCUMENTS 53-161366 12/1978 Japan .

*Primary Examiner*—William E. Tapolcai
*Attorney, Agent, or Firm*—Burns, Doane, Swecker & Mathis, L.L.P.

[57] ABSTRACT

A shelf structure for use in a freezer compartment of a refrigerator includes a horizontal shelf and a base formed integrally of one piece with the shelf. The base extends downwardly from the shelf and includes upper and lower pairs of guide rails. A case is slidably supported on the upper guide rails and carries ice cube trays which are rotatable relative to the case for ejecting ice cubes. An ice cube storage bin is slidably mounted on the lower guide rails beneath the trays for receiving the ejected ice cubes.

10 Claims, 3 Drawing Sheets

FREEZER COMPARTMENT STRUCTURE FOR REFRIGERATORS

BACKGROUND OF THE INVENTION

1. Field of the Invention

The present invention relates, in general, to a freezer compartment structure for refrigerators.

2. Description of the Prior Art

A typical refrigerating system for refrigerators is schematically shown in FIG. 1. As shown in the drawing, the typical refrigerating system includes a compressor 4, which receives the low temperature and low pressure refrigerant gas through a suction pipe 1 and compresses the refrigerant gas in order to provide high temperature and pressurized refrigerant gas and supplies the pressurized hot refrigerant gas to a condenser 3. The above refrigerating system also includes a capillary tube 5, wherein the pressurized hot refrigerant gas emits heat to the atmospheric air so that the refrigerant gas is condensed and becomes liquid refrigerant. The refrigerating system further includes an evaporator 6, wherein the low temperature liquid refrigerant absorbs heat from air thus cooling the air. The cold air generated by the evaporator 6 is distributed into the freezer and refrigeration compartments of a refrigerator by a blower.

The cold air generated by the evaporator of the above refrigerating system is sucked into the freezer and refrigeration compartments by the suction force of a fan and repeatedly circulates inside the compartments. The fan is exclusively turned on when a freezer thermostat, which automatically controls the temperature inside the freezer compartment, is turned on.

FIG. 2 shows the construction of a conventional refrigerator. As shown in FIG. 2, the conventional refrigerator includes a freezer compartment 21, which is typically formed inside the cabinet or housing at a position above the evaporator 6. In the freezer compartment 21, a base 10 and a food holding shelf 11 are installed. In addition, three compartments, that is, a vegetable compartment 22, a fresh food compartment 23 and a refrigeration compartment 24, are formed inside the cabinet under the evaporator 6. The vegetable and fresh food compartments 22 and 23 are provided inside the refrigeration compartment 24. Each of the vegetable and fresh food compartments 22 and 23 maintains the appropriate temperature and an appropriate percentage of humidity and thereby maintains the freshness of food, which is stored in the compartment, for a lengthy period of time. A plurality of shelves 29 are provided in the refrigeration compartment 24.

A part of the cold air, which is sucked from the evaporator 6 by the suction force of a fan 25, is introduced into the freezer compartment 21 through a passage bordered by an inner wall or cabinet 26 of the freezer compartment 21. The fan 25 is operated by a freezer thermostat (not shown), which automatically controls the temperature inside the freezer compartment 21. The other part of the cold air of the evaporator 6 is introduced into the refrigeration compartment 24 through a passage bordered by an inner wall or cabinet 28 of the refrigeration compartment 24. In this case, the amount of cold air introduced into the refrigeration compartment 24 is controlled by a damper 27, which is installed on a predetermined position inside the compartment 24.

The construction of a conventional freezer compartment can be referred to, for example, Japanese U.M. Laid-open Publication No. Sho. 53-161366.

FIG. 3 shows the construction of a conventional freezer compartment of a refrigerator. As shown in FIG. 3, a base 10 is installed in a corner of the freezer compartment. The base 10 includes a plurality of movable ice cube trays 8 and a slidable ice bin 9. The ice cube trays 8, which make ice cubes, are mounted to a slidable case and are rotatably movable relative to the case. The ice bin 9, which is used for containing the formed ice cubes dispensed from the trays 8, is slidably mounted to the base 10 at a position under the trays 8.

A food holding shelf 11 is horizontally installed inside the freezer compartment at a position under the base 10 and is used for holding food to be stored inside the freezer compartment.

In the freezer compartment, the base 10 and shelf 11 are separately produced prior to mounting them to their places on the inner cabinet 7 of the freezer compartment. In this regard, the assembling of the above base 10 and shelf 11 wastes labor, reduces work efficiency, takes too long and costs too much.

U.S. Pat. No. 5,273,354 disclosed a lower shelf which can slide under the guidance of the guide rails provided on an upper shelf.

It is possible to provide a base which is movable under the guidance of the guide rails provided on the shelf of the freezer compartment. However, the shelf of a conventional freezer compartment has been typically installed on the inner cabinet so that the shelf not only moves forward and backward under the guidance of the guide rails formed on the inner cabinet, it is also removable from the inner cabinet. In addition, both the ice cube tray's case and the ice bin have been typically installed in the freezer compartment so that they can slide forward and backward under the guidance of the guide rails formed on the base. In this regard, it is not particularly necessary to make the base movable under the guidance of the guide rails. Another problem of the typical base resides in the need for the shelf and base to be separately produced prior to mounting them to their places in the freezer compartment even when the base has a construction which allows the base to move under the guidance of the guide rails.

SUMMARY OF THE INVENTION

It is, therefore, an object of the present invention to provide a freezer compartment structure for refrigerators in which the above problems can be overcome and which integrates a shelf and a base. The base detachably holds an ice cube tray and an ice bin. The shelf of the freezer compartment is integrated into a single body with the base, thus improving labor efficiency and reducing the cost involved in assembling the freezer compartment.

In order to accomplish the above object, a freezer compartment structure for refrigerators in accordance with the invention comprises a horizontal shelf adapted for holding food thereon and a base integrated with the shelf into a single body, the base detachably holding at least one ice cube tray and an ice bin therein.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
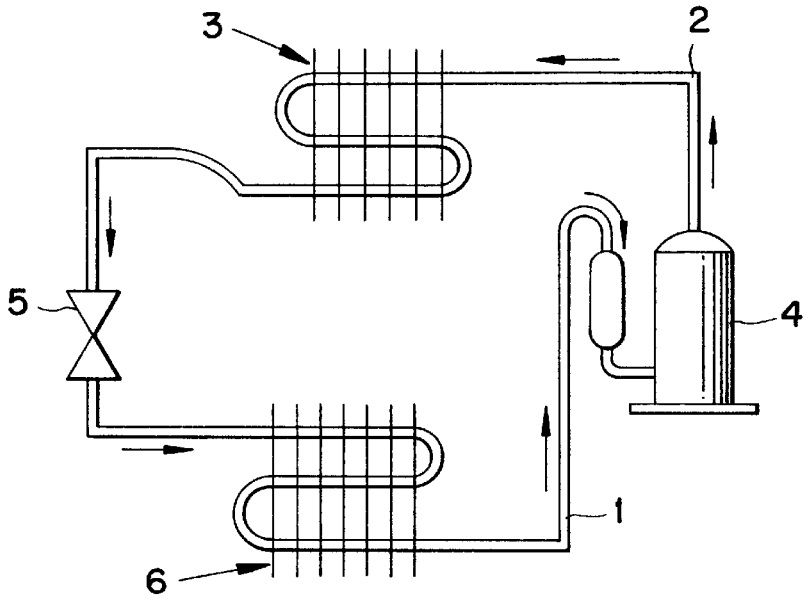
FIG. 1 PRIOR ART
FIG. 1 is a schematic diagram showing the construction of a typical refrigerating system for refrigerators.
Figure 3:
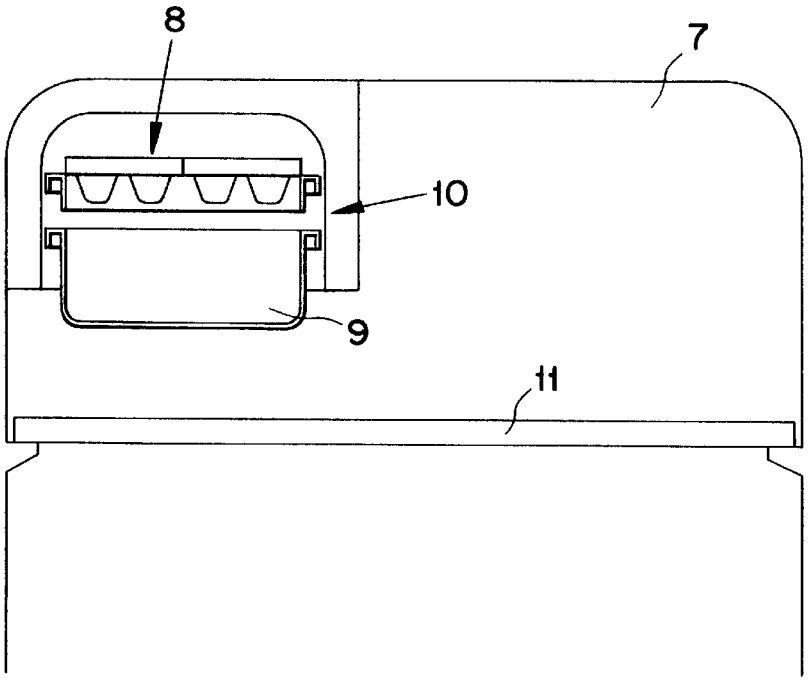
FIG. 3 PRIOR ART
FIG. 3 is a front schematic view showing the construction of a conventional freezer compartment for refrigerators.
Figure 2:
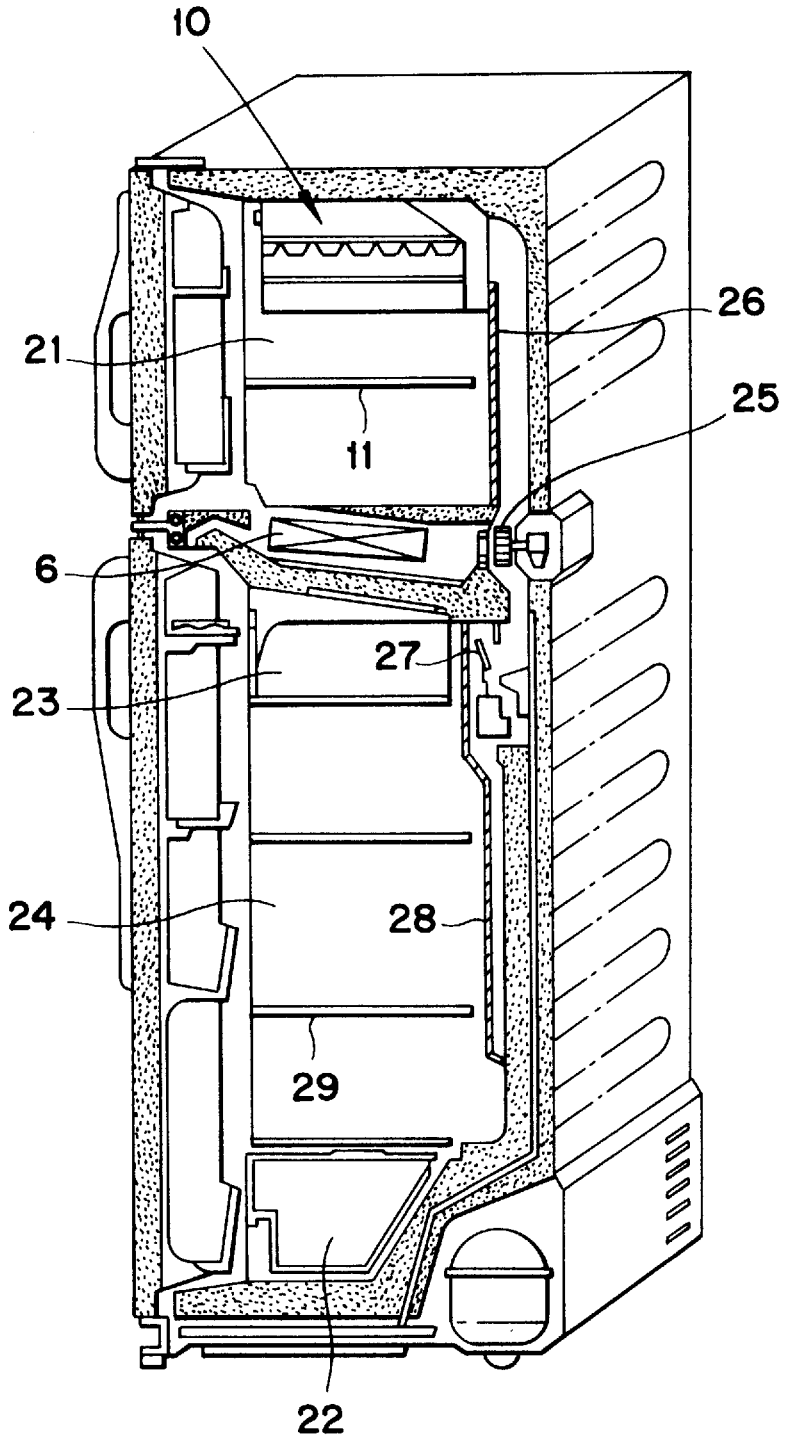
FIG. 2 PRIOR ART
FIG. 2 is a perspective schematic broken-away view showing the construction of a conventional refrigerator.
Figure 4:
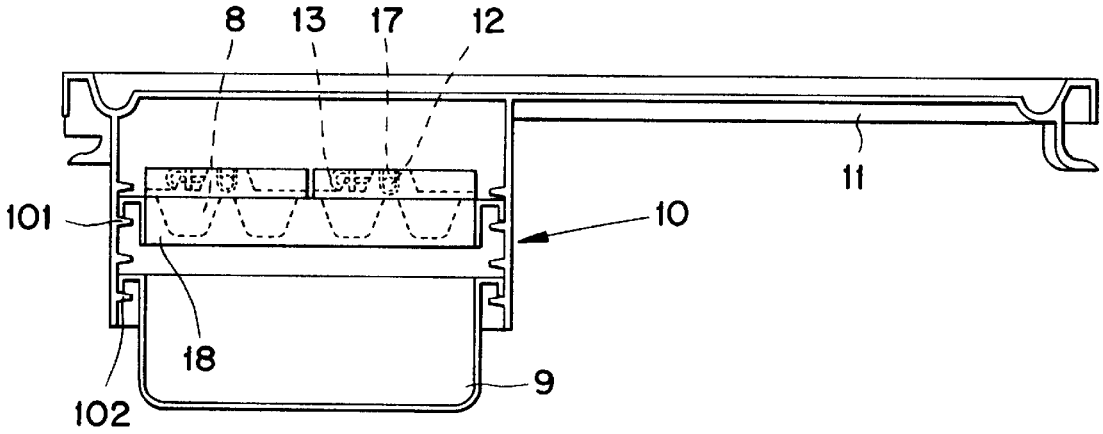
FIG. 4 is a front view showing the construction of a freezer compartment for refrigerators in accordance with the preferred embodiment of the present invention.

FIG. 4 shows the construction of a freezer compartment for refrigerators in accordance with a preferred embodiment of the present invention. As shown in FIG. 4, the freezer compartment of this invention has a food holding shelf 11, which is horizontally installed in the freezer compartment and holds food thereon. In accordance with the present invention, a base 10 is integrated with one side bottom of the shelf 11 into a single body. The base 10 detachably holds both the ice cube trays 8 and the ice bin 9.

The ice cube trays 8, which make ice cubes, are mounted to a slidable case 18 so that the trays 8 are rotatably movable relative to the case 18. The case 18 slidably engages with upper guide rails 101 of the base 10 so that the case 18 can slide forward and backward under the guidance of the rails 101 in the same manner as a conventional drawer. Each ice cube tray 8 has a plurality of individual ice cube compartments, which contain water in order to make ice cubes.

The ice bin 9 is placed under the slidable case 18 and contains the formed ice cubes dispensed from the ice cube trays 8. The ice bin 9 slidably engages with the lower guide rails 102 of base 10 so that the ice bin 9 can slide forward and backward under the guidance of the rails 102.

The operational effect of the above freezer compartment will be described hereinbelow.

The food holding shelf 11 and base 10 are formed into a single body. The single body of the shelf 11 and base 10 is mounted to a predetermined position inside the freezer compartment. In this case, the ice cube tray's case 18 slidably engages with the upper guide rails 101 of the base 10 so that the case 18 can slide forward and backward under the guidance of the rails 101. The ice cube trays 8 are mounted to the slidable case 18 so that the trays 8 are rotatably movable relative to the case 18. In order to pivotally mount the trays 8 to the case 18, each ice cube tray 8 is provided with a hinge pin 12, which is received in a hinge hole 17 of the case 18. A tray rotating handle 13 extends from the hinge pin 12.

The ice bin 9, which contains the formed ice cubes dispensed from the ice cube trays 8, slidably engages with the lower guide rails 102 of the base 10 at a position under the slidable case 18 so that the ice bin 9 can slide forward and backward under the guidance of the rails 102.

In order to make ice cubes, water is introduced into the ice cube trays 8 to a predetermined depth of each compartment of the trays 8 prior to slidably inserting the trays 8 into the base 10. The water inside the compartments of the trays 8 is formed into ice cubes due to the low temperature inside the base 18. In order to dispense the formed ice cubes from the trays 8 into the ice bin 9, the tray rotating handles 13 of the hinged trays 8 are manually rotated relative to the case 18 so that the formed ice cubes are removed from the compartments of the trays 8 and are dispensed from the trays 8 into the ice bin 9. In order to use the formed ice cubes, a user opens or draws out the ice bin 9 and takes a desired quantity of ice cubes from the ice bin 9.

As described above, the present invention provides an improved freezer compartment structure for refrigerators. In the freezer compartment of this invention, the base, which detachably holds the ice cube trays and ice bin for making ice cubes, is integrated with the food holding shelf of the freezer compartment into a single body. The single body of the shelf and base is mounted to a predetermined position inside the freezer compartment. The invention thus improves work efficiency and reduces the cost while assembling the freezer compartment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a housing forming a freezer compartment the housing forming a top wall of said freezer compartment;

a shelf structure disposed in said freezer compartment and including:

a horizontal shelf disposed beneath, and spaced from, said top wall and adapted to support food;

a base formed integrally of one piece with said shelf to form therewith a single body, said base extending downwardly from an underside of said shelf and including upper and lower pairs of guide rails;

a case horizontally slidably supported on said upper pair of guide rails;

a tray rotatably supported by said case for rotation about a horizontal axis; and an ice cube storage bin horizontally slidably supported on said pair of guide rails, for receiving ice from said tray when said tray is rotated relative to said case.

2. The refrigerator according to claim 1 wherein said bin is supported by said base beneath said tray.

3. The refrigerator according to claim 1 wherein said base includes upper and lower pairs of guide rails, said tray and bin horizontally slidably supported on said upper and lower pairs of guide rails respectively.

4. The refrigerator according to claim 3 wherein said base extends downwardly from an underside of said shelf.

5. The refrigerator according to claim 1 wherein said base extends downwardly from an underside of said shelf.

6. The refrigerator according to claim 1 further including a case horizontally slidably supported on said base, said tray rotatably mounted on said case for rotation about a horizontal axis.

7. The refrigerator according to claim 6 wherein said bin is horizontally slidably supported beneath said case to receive ice cubes from said tray when said tray is rotated relative to said case.

8. The refrigerator according to claim 7, wherein said tray constitutes a first tray, and further including a second tray rotatably mounted to said case next to said first case for rotation about a horizontal axis.

9. The refrigerator according to claim 1 wherein said tray is horizontally slidably supported on guide rails formed on said base.

10. The refrigerator according to claim 1 wherein said bin is horizontally supported on guide rails formed on said base.

* * * * *